US005523734A

United States Patent [19]

Beck et al.

[11] Patent Number: 5,523,734

[45] Date of Patent: Jun. 4, 1996

[54] TURN-TO-TURN GROOVED INSULATING TUBE AND TRANSFORMER INCLUDING SAME

[75] Inventors: Kenneth R. Beck; E. Franklin Deacon; Mike Bennett; Sam H. Lee, all of Nacogdoches, Tex.

[73] Assignee: Cooper Industries, Houston, Tex.

[21] Appl. No.: 343,980

[22] Filed: Nov. 18, 1994

[51] Int. Cl.[6] ..... H01F 27/30

[52] U.S. Cl. ..... 336/185; 336/208; 336/198

[58] Field of Search ..... 336/185, 198, 336/208

[56] References Cited

U.S. PATENT DOCUMENTS

| | | | |
|---|---|---|---|
| 1,558,090 | 10/1925 | Howard . | |
| 1,621,456 | 3/1927 | Brown et al. . | |
| 1,624,896 | 4/1927 | Veitch . | |
| 1,760,975 | 6/1930 | Davis et al. . | |
| 1,876,670 | 9/1932 | Heintz . | |
| 1,891,456 | 12/1932 | Smith . | |
| 2,205,236 | 6/1940 | Arnold . | |
| 2,850,666 | 9/1958 | Brewer . | |
| 2,971,150 | 2/1961 | Prindle . | |
| 3,046,509 | 7/1962 | Wuczkowski . | |
| 3,561,111 | 2/1971 | Beck et al. . | |
| 3,705,372 | 12/1972 | Gotal et al. | 336/182 |
| 3,815,069 | 6/1974 | Palazzetti et al. | 336/200 |
| 4,063,207 | 12/1977 | Williams . | |
| 4,135,294 | 1/1979 | Brown . | |
| 4,638,282 | 1/1987 | Ellison . | |
| 4,761,629 | 8/1988 | Martin et al. | 336/208 |
| 5,281,942 | 1/1994 | Stokes | 336/192 |
| 5,332,989 | 7/1994 | Ching | 336/208 |

*Primary Examiner*—Leo P. Picard
*Assistant Examiner*—G. R. Lord
*Attorney, Agent, or Firm*—Burns, Doane, Swecker & Mathis

[57] ABSTRACT

A turn-to-turn grooved insulating tube includes a tubular member having a substantially continuous rib helix formed on an outer surface. The rib helix defines a substantially continuous helical groove for receiving a conductor for forming a coil of a transformer.

26 Claims, 5 Drawing Sheets

TURN-TO-TURN GROOVED INSULATING TUBE AND TRANSFORMER INCLUDING SAME

FIELD OF THE INVENTION

The present invention relates to transformers and, more particularly, to transformers including an insulating tube.

BACKGROUND OF THE INVENTION

In transformers, two or more multi-turn coils of conducting material are arranged so that any magnetic flux linking one coil will link the other coils, also. The mutual inductance existing between the coils transfers energy from one input coil, or primary winding, to the other coils, or secondary windings.

When a high current is supplied to the transformer, the coils are urged to attain a spherical shape and tend to fly apart, both radially and axially. It is known that, by gluing the coils to a core or binding the coils with material such as an insulative wrapping paper, it is possible to minimize the tendency of the coils to fly apart. It is, however, desirable to further minimize production steps in transformer manufacturing.

It is generally necessary to insulate successive turns of the coil from one another and to insulate concentric coils from one another to prevent shorting. To this end, it is common to form coils from conductors having a thin insulative coating in the form of a thin film or a nylon mesh. The insulative coating must, however, be removed from the conductor at weld and termination points. Moreover, shorting may occur where the thin insulative coating is abraded, such as when core steel is provided in an opening defined by an inner coil. Typically, protective material such as pressboard is provided at various points around such an opening to prevent damage to the insulation of the coil. It is desirable to avoid the need for insulative coatings and protective material in a transformer.

Beside providing insulative coatings on the conductors forming the coils, primary and secondary coils may be insulated from each another as shown, for example, in U.S. Pat. No. 1,558,090, which teaches cutting a spiral groove in an insulative cylindrical supporting member and forming a primary coil by winding bare wire around the member in the groove. A secondary coil is formed around the member and is prevented from contacting the primary coil either through the use of a conductor too large to be received in the groove, by filling the groove with insulating material prior to winding the conductor, or by winding the conductor so that the turns of the secondary coil do not enter the grooves. U.S. Pat. No. 2,205,236 teaches forming a core or supporting member and positioning a molded insulative spiral having an interior diameter equal to the exterior diameter of the core around the core to insulate successive turns of the winding. The foregoing techniques suffer disadvantages including requiring substantial processing of the insulative member or members prior to winding the conductors.

U.S. Pat. No. 3,046,509 teaches forming a coil by winding a conductor around a mandrel together with a split flexible insulating flange having an L-shape, wherein one of the legs of the L-shaped flange extends radially between adjacent turns of the coil to separate them from one another. A pair of plates are arranged at opposite ends of the coils to hold the conductors and insulating material tightly together.

It is desirable to provide a turn-to-turn insulating member that requires minimal processing. It is further desirable to provide a means for simplifying the formation of insulated coil turns.

SUMMARY OF THE INVENTION

It is an object of the present invention to provide a turn-to-turn insulating member that is simple to produce. It is a further object of the present invention to provide a turn-to-turn insulating member that permits the production of a sturdy coil arrangement. It is still a further object of the present invention to provide a means for simplifying the formation of insulated coil turns.

In accordance with one aspect of the present invention, a turn-to-turn grooved insulating tube for use in a transformer having one or more conductor winding turns is provided. The insulating tube is preferably formed from a flat member having first and second longitudinal edges joined together to form a tube. A rib helix is formed on the outer surface of the insulating tube. The rib helix defines a substantially continuous helical groove on the outer surface for receiving a conductor wound around the tubular member in one or more winding turns.

The insulating tube facilitates the use of uncoated conductors for forming coils. Successive turns of the conductors are insulated from one another by the rib helix. Further, the rib helix serves to prevent a coil wrapped around the insulating tube, and forming a part of a transformer, from flying apart axially when a voltage is supplied to the transformer. Further still, the helical groove defined by the rib helix serves to align the conductor as the conductor is wound around the insulating tube to form the coil.

According to another embodiment of the invention, a transformer winding includes concentric inner and outer insulating tubes. A first coil formed from a first conductor is disposed in the helical groove of the inner insulating tube and a second coil formed from a second conductor is disposed in the helical groove of the outer turn-to-turn grooved insulating tube.

According to a further embodiment of the present invention, a turn-to-turn grooved insulating tube is made according to a method in which a substantially rectangular flat member having an inner and an outer surface, a first and a second longitudinal edge, and a first and a second transverse edge is formed. A plurality of parallel ribs having first and second ends on the outer surface are provided. The first ends of the ribs extend substantially to the first longitudinal edge and the second ends of the ribs extend substantially to the second longitudinal edge. The first longitudinal edge is joined to the second longitudinal edge. The ribs form an angle with the first and second transverse edges such that, when the first and second longitudinal edges are joined, the first ends of substantially all of the ribs align with a second end of an adjacent one of substantially all of the ribs, the aligned ribs forming a rib helix.

According to yet another aspect of the present invention, a transformer includes a winding having first and second coils formed from first and second conductors wound in helical grooves formed on inner and outer insulating tubes, respectively.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
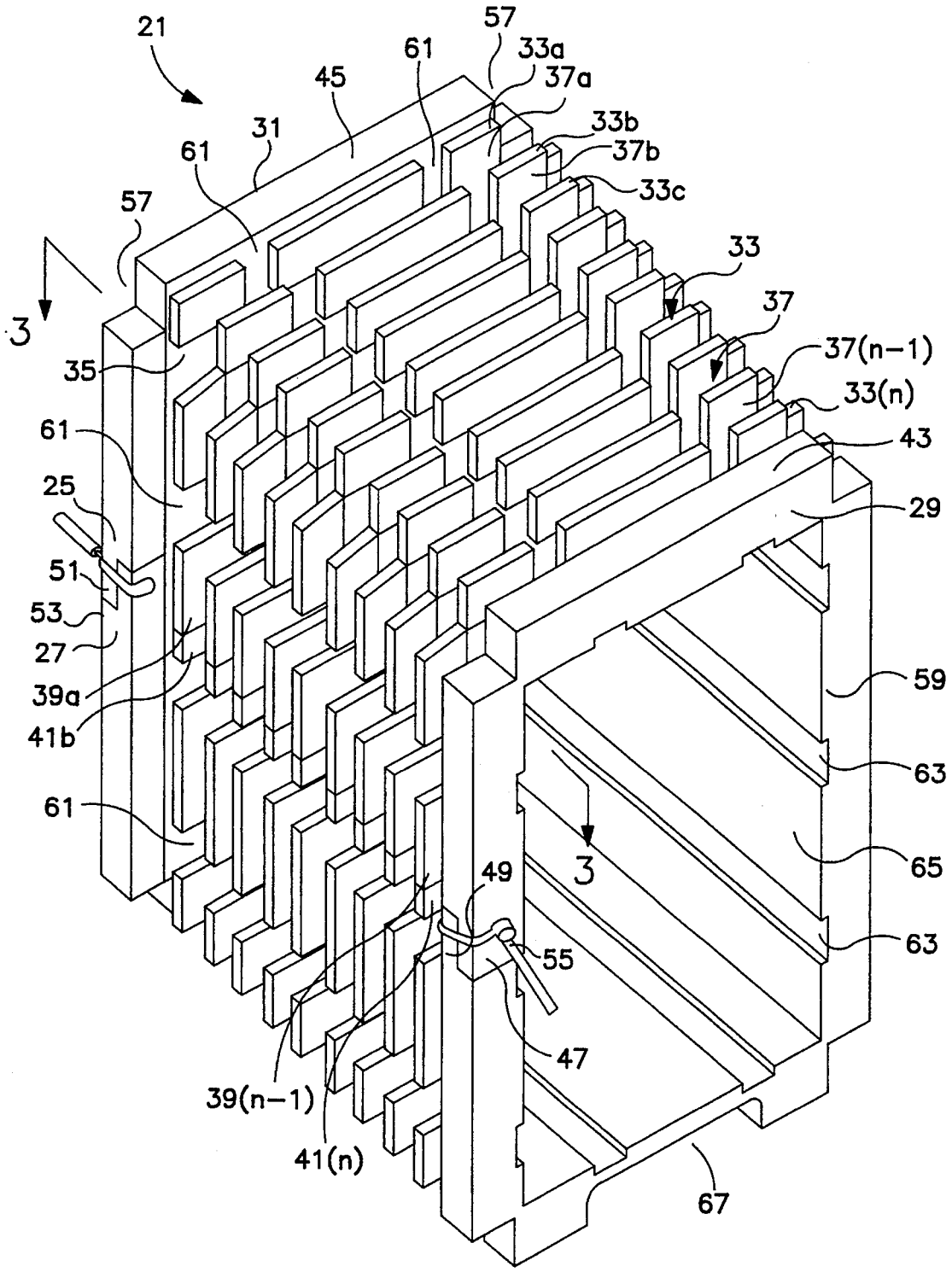
FIG. 1 is a perspective view of an insulating tube according to an embodiment of the present invention.
Figure 2:
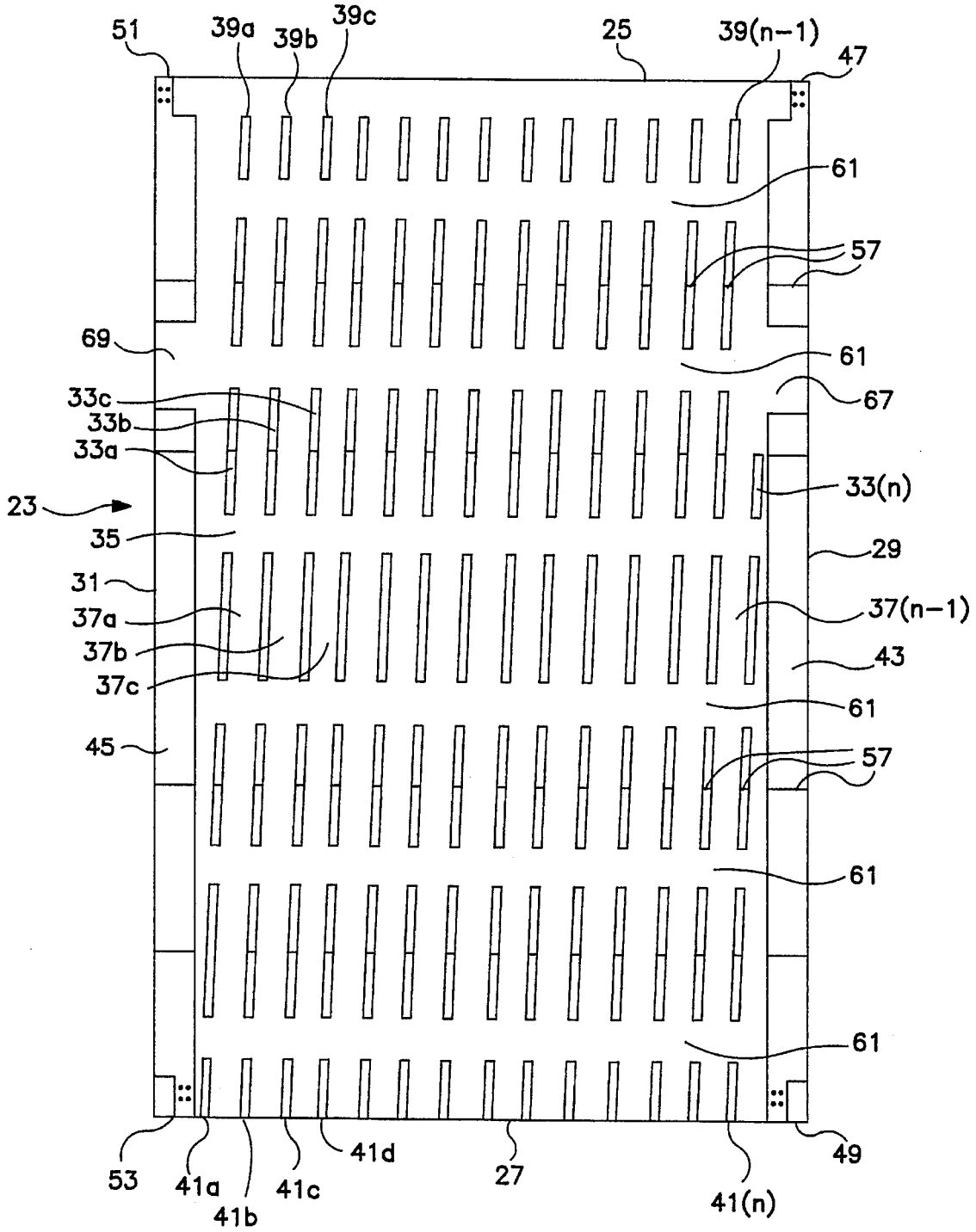
FIG. 2 is a top view of a molded member for forming an insulating tube according to an embodiment of the present invention.

An embodiment of a turn-to-turn grooved insulating tube 21 according to the present invention for use in connection with a transformer is seen with reference to FIG. 1. The insulating tube 21 is described below primarily in connection with single-phase, core-type transformers, however, it is understood that the insulating tube facilitates providing, for example, insulation between successive coil turns, providing insulation between concentric coils, providing a rigid structure for supporting transformer coils, and providing guides for winding transformer coils in most other types of transformers as well, such as shell-type transformers and three-phase transformers. The insulating tube 21 is preferably formed from a flat member 23, such as is seen in FIG. 2, which is preferably formed by molding. The insulating tube 21 may also be formed as a tube, preferably by molding. The flat member 23 is preferably substantially rectangular, having first and second longitudinal edges 25 and 27, respectively, and front and rear transverse edges 29 and 31, respectively.

Figure 3:
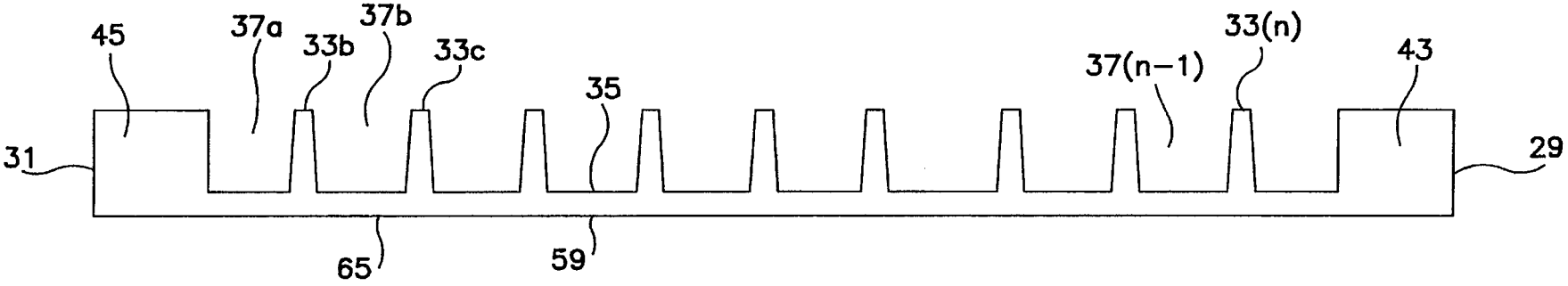
FIG. 3 is a cross-sectional view of the molded member of FIG. 3, taken at section 3—3.

As seen in FIG. 2, one or more ribs 33*a*, 33*b*, . . . , 33(*n*) extend, parallel to one another and at an angle to the transverse edges 29 and 31, between the first and second longitudinal edges 25 and 27 of an outer surface 35 of the flat member 23. As seen in FIGS. 1–3, the ribs 33*a*, 33*b*, . . . , 33(*n*) define grooves 37*a*, 37*b*, . . . , 37(*n*-1) between adjacent ones of the ribs. The angle at which the ribs extend is such that, when the flat member 23 is bent and the longitudinal edges 25 and 27 are joined together to form the insulating tube 21, a first end 39*a*, 39*b*, . . . , 39(*n*-1) of all of the ribs, except the rib 33(*n*), aligns with a second end 41*b*, 41*c*, . . . , 41(*n*), respectively, of a succeeding one of all of the ribs, except the rib 33*a*. The individual ribs 33*a*, 33*b*, . . . , 33(*n*) thus form a substantially continuous rib helix or spiral 33, and the rib helix defines a continuous groove helix 37, on the insulating tube 21. The ribs are spaced sufficiently far apart that a conductor for forming a coil is able to be received in the groove helix 37 formed by the rib helix 33.

The transverse edges 29 and 31 of the flat member 23 are preferably provided with flanges 43 and 45, respectively, to facilitate joining the longitudinal edge 25 with the longitudinal edge 27 and to add rigidity to the insulating tube 21. As seen in FIGS. 1 and 2, first and second ends 47 and 49 of the flange 43 and first and second ends 51 and 53 of the flange 45 are provided with reduced thicknesses to form lap joints when the flat member 23 is bent to form the insulating tube 21, the first and second flanges thereby forming substantially continuous, constant thickness flanges surrounding the insulating tube. The first and second ends 47 and 49 and the first and second ends 51 and 53 are secured together, preferably with plastic ties 55 or pins extending through aligned holes formed in the reduced thickness ends of the flanges. Other suitable means for joining the longitudinal edges 25 and 27 are well known, such as joining the edges with adhesives or by chemical or thermal fusing. The longitudinal edges 25 and 27 preferably overlap at the joint, and the ribs 33*a*, 33*b*, . . . , 33(*n*) do not extend to the one of the edges that is intended to be on the inside of the insulating tube to permit the overlap.

The flat member 23 is preferably bent to form a substantially square or rectangular insulating tube 21. To facilitate bending of the flat member 23, the flat member is preferably provided with breaks or cuts 57 through the ribs 33*a*, 33*b*, . . . , 33(*n*) and the flanges 43 and 45, the breaks or cuts preferably being parallel to the longitudinal edges 25 and 27 at points where it is desired to bend the flat member. When it is desired to form, for example, more rounded comers, two or more breaks or cuts 57 are formed in the flat member at bend points. If it is desired to form shapes other than rectangles, such as substantially circular shapes, additional breaks or cuts 57 are formed as required to facilitate bending. The breaks or cuts 57 preferably only extend to or near the bases of the ribs and the flanges, the wall 59 of the flat member remaining uncut. The breaks or cuts 57 are preferably formed in an already-formed flat member 23, however, the breaks or cuts may be molded with the flat member.

If desired, such as where the flat member 23 is formed of a sufficiently flexible material, the longitudinal edges 25 and 27 are joined together without forming any breaks or cuts in the flat member. Further, if desired, the rib helix 33 and the flanges 43 and 45 may be formed on an already-formed tube, such as by winding a continuous rib and continuous flanges around a tube and joining the rib and the flanges to the tube by means such as adhesives or through thermally or chemically fusing the rib helix to the tube.

Longitudinal grooves 61, preferably parallel to the longitudinal edges 25 and 27, are provided through the ribs 33*a*, 33*b*, . . . , 33(*n*). The grooves 61 preferably extend to the bases of the ribs and facilitate flow of coolant, usually oil, around coils in a transformer including the insulating tube 21. If desired, the grooves 61 may also extend through the flanges 43 and 45 on the front and rear transverse edges 29 and 31. Longitudinal grooves 63 are preferably also provided, parallel to the longitudinal edges 25 and 27, in the wall 59 of the flat member 23 on an inner surface 65 of the flat member, further facilitating the flow of coolant around the coils of a transformer. The grooves 61 and 63 are preferably molded with the flat member 23, however, the grooves may be formed after the flat member is formed, such as by machining away portions of the ribs 33*a*, 33*b*, . . . , 33(*n*) and the wall 59. Recesses 67 and 69 are preferably provided in the flanges 43 and 45, respectively, to permit a conductor for forming a coil wrapped around the insulating tube to extend through the flanges.

Figure 4:
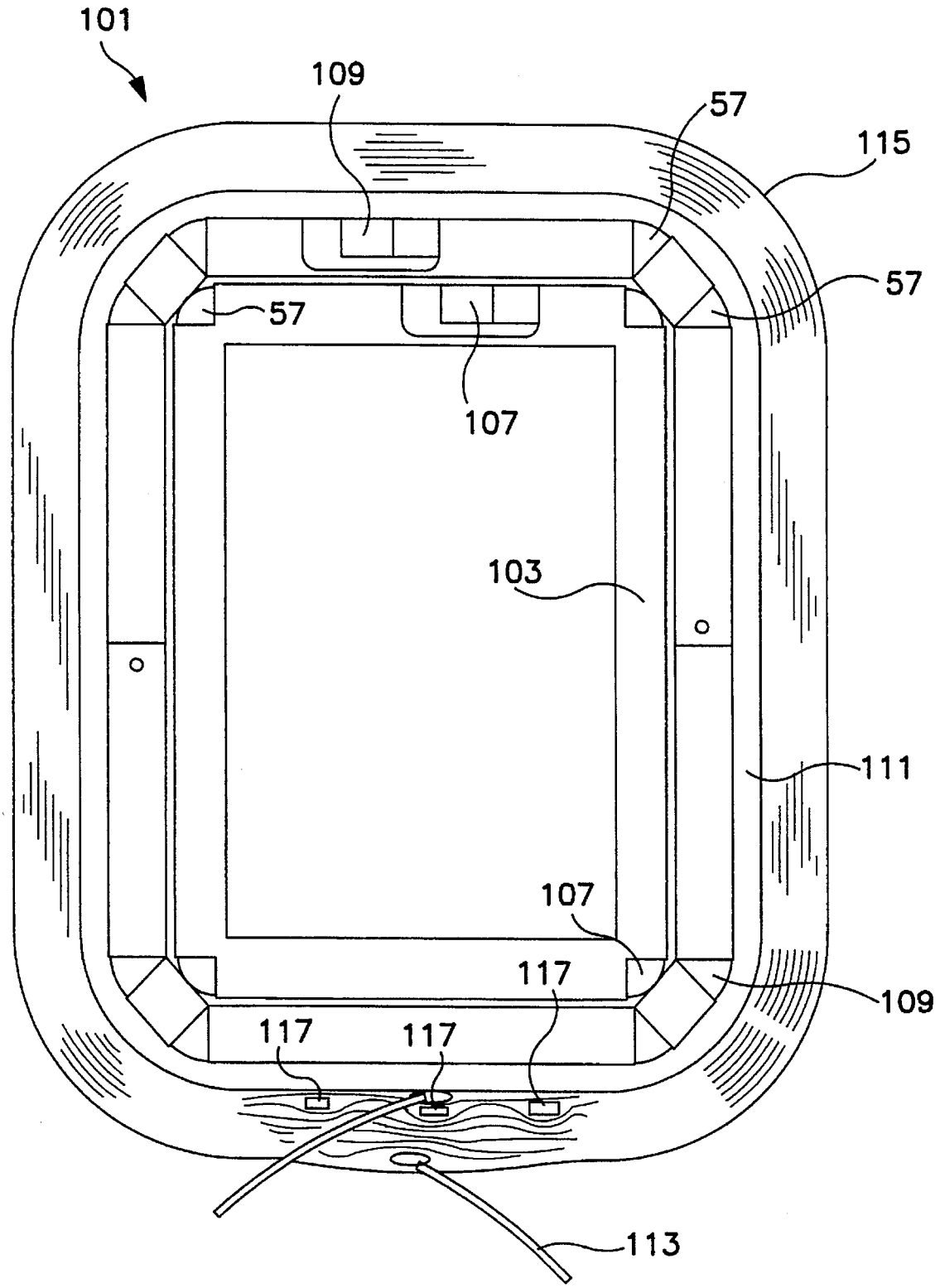
FIG. 4 is an end view of a transformer winding according to an embodiment of the present invention.

A winding 101 according to the present invention preferably includes an inner insulating tube 103 and an outer insulating tube 105, as seen with reference to FIG. 4. The inner and outer insulating tubes 103 and 105 are preferably sized such that the exterior periphery of the inner insulating tube is substantially the same size as the interior periphery of the outer insulating tube. Preferably, separate conductors 107 and 109 are wound around the inner and outer insulating tubes 103 and 105, respectively, to form concentric low voltage coils. During winding of the conductors 107 and 109, the helical grooves defined by the rib spirals 33 on the inner and outer insulating tubes 103 and 105 serve to properly align the conductors.

The inner insulating tube 103 is preferably formed with four breaks or cuts 57 to form substantially 90° corners, and the outer insulating tube 105 is preferably formed with eight breaks or cuts, with two sets of four breaks or cuts defining more rounded interior comers to facilitate conforming the interior shape of the outer insulating tube with the exterior shape of the inner insulating tube. The joined longitudinal edges 25 and 27 of the inner insulating tube 103 are preferably arranged on different sides, most preferably on opposite sides, of the winding 101 from the joined longitudinal edges 25 and 27 of the outer insulating tube to provide rigidity to the winding by avoiding adjacent joined edges. The conductors 107 and 109 preferably enter and leave the winding 101 at adjacent, or nearly adjacent points at the front transverse edge 29 and the rear transverse edge (not shown) of the inner and outer insulating tubes.

Because the rib helix 33 of the inner and outer insulating tubes 103 and 105 preferably completely insulate the successive turns formed by the conductors 107 and 109 from one another, and the wall 59 of the outer insulating tube insulates the concentric coils formed by the two conductors from each other, it is not necessary to provide an insulative coating on the conductors. The use of bare conductors 107 and 109 facilitates forming electrical connections with those conductors. The size of the rib helixes 33 on the inner and outer insulating tubes 103 and 105, and the thickness of the walls 59 of the flat members used to form the insulating tubes are preferably selected to meet appropriate electrical code requirements for insulation of coils. The conductors 107 and 109 are preferably substantially square or rectangular in cross-section and are contacted on substantially all of three sides by surfaces of the rib helix 33 and the outer surface 35 of the inner and outer insulating tubes 103 and 105, respectively.

Upper portions of the conductors 107 and 109 preferably extend slightly above the tops of the rib helixes 33 on the inner and outer insulating tubes 103 and 105 to facilitate the flow of coolant around the coils formed by the conductors. In this manner, a small gap for permitting coolant flow is provided between the inner surface 65 of the outer insulating tube 105 and the tops of the rib helix 33 and the flanges 43 and 45 at the front and rear transverse edges 29 and 31 of the inner insulating tube 103. A similar small gap may also be provided, if desired for cooling, between the tops of the rib helix 33 and the flanges 43 and 45 at the front and rear transverse edges 29 and 31 of the outer insulating tube 105 and insulation 111 around the coil formed by the second conductor 109.

The outer insulating tube 105 is preferably formed with longitudinal grooves 63 extending through the rib helix 33 to facilitate circulation of coolant around the coil formed by the conductor 109. The outer insulating tube 105 is preferably further formed with longitudinal grooves 61 on the inner surface 65 of the flat member forming the outer insulating tube to facilitate circulation of coolant around the coil formed by the conductor 107. If desired, the inner insulating tube 103 is also formed with longitudinal grooves 63 extending through the rib helix 33 to further facilitate circulation of coolant around the coil formed by the conductor 107.

The rib helixes 33 are preferably sufficiently strong to prevent the conductors 107 and 109 forming the coils from flying apart axially when a high current is supplied to the winding 101. Further, the outer insulating tube 105 assists in preventing the coil formed by the first conductor 107 from flying apart radially. Insulating wrapping material 111, preferably paper or cardboard, is preferably wrapped around the outer insulating tube 105 and the coil formed by the conductor 109. The wrapping material 111 prevents the coils from flying radially apart and serves as insulation for the coil formed by the conductor 109.

A high voltage coil 113 is wound around the wrapping material 111. The high voltage coil 113 is preferably in the form of a series of concentric coils, each concentric coil preferably being comprised of a number of turns, formed from a single conductor in a known manner. The concentric coils preferably being insulated from one another with further wrapping material 115. One or more non-conductive blocks 117, preferably wooden or fiberboard strips, are preferably provided between at least some of the concentric coils of the high voltage coil 113 and the wrapping material 114 to facilitate the flow of coolant around the high voltage coil.

If desired, instead of wrapping the high voltage coil 113 in wrapping material 115 and insulating the high voltage coil from the low voltage coil formed by the second conductor 109 with the wrapping material 111, the high voltage coil may be wound in a turn-to-turn grooved insulating tube (not shown) similar to the inner and outer insulating tubes 103 and 105. If the high voltage coil 113 comprises a number of concentric coils, multiple insulating tubes may be used.

Figure 5:
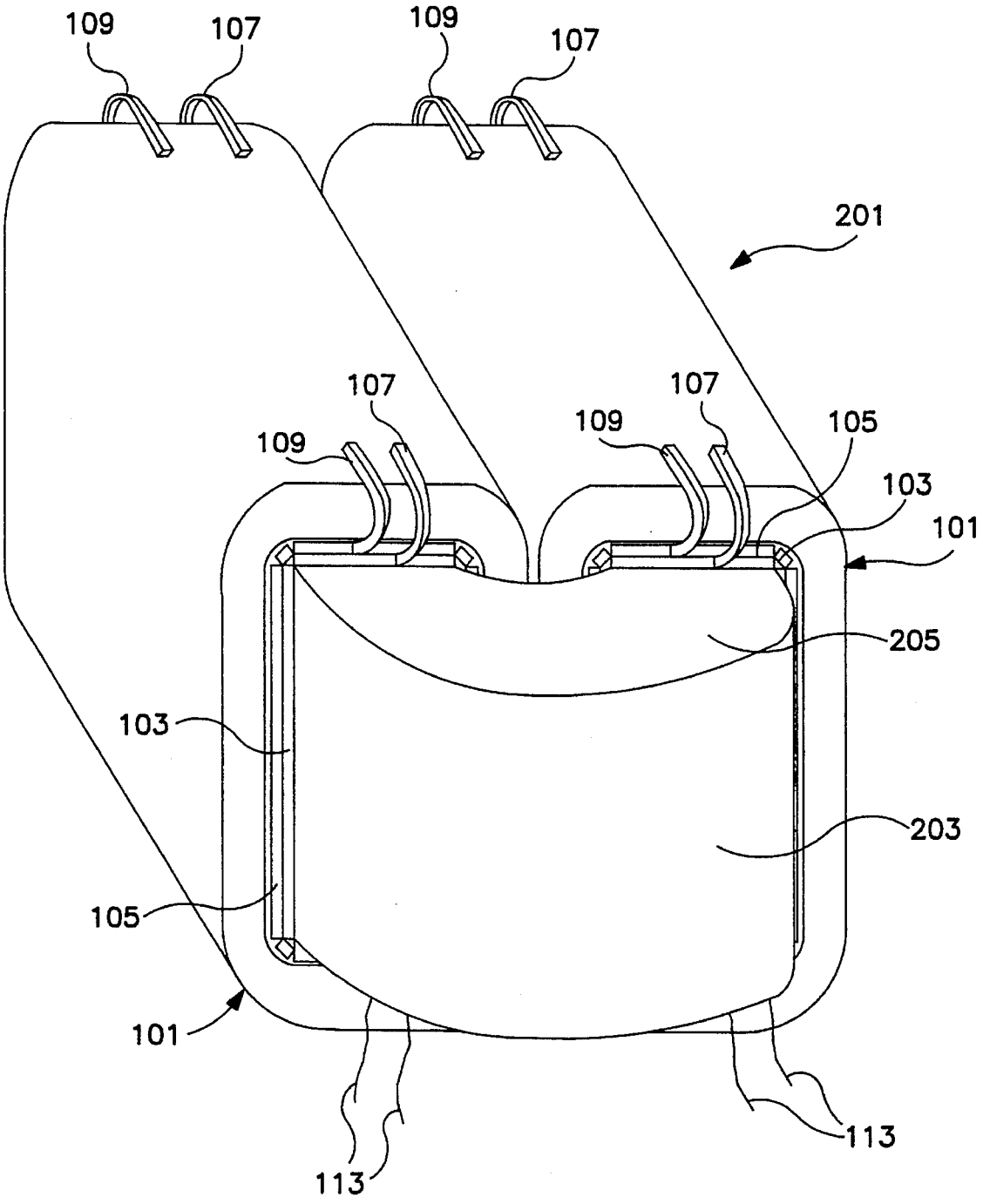
FIG. 5 is a perspective view of a core-type transformer according to an embodiment of the present invention.

A core-type transformer 201 according to the present invention is seen with reference to FIG. 5. The transformer 201 includes a pair of windings 101 and a core 203. The sharp edges 205 of the core 203 are prevented from contacting the coil of the transformer 101 formed by the first conductor 107 by the inner insulating tube 103. In practice, the transformer 201 is immersed in oil (not shown) in a tank (not shown), the oil providing cooling to the transformer during operation.

The inner insulating tube 103 is preferably formed of a material having a high degree of resistance to abrasion and having a low coefficient of friction in contact with typical core materials. A preferred material for the inner insulating tube 103 is Nylon 6/6 or Nylon 6/12 available from E. I. DuPont DeNemours Co., Wilmington, Del., with or without glass filler. The outer insulating tube 105 is preferably made of the same material. Use of such materials facilitates easily inserting a core 203 into the opening defined by the inner surface 65 of the inner insulating tube 103 without damaging the insulation provided by the wall 59 of the inner insulating tube.

Cooling efficiencies of transformers including windings formed with plastic core turn-to-turn grooved insulating tubes according to the present invention were compared with cooling efficiencies of identical transformers using standard cores through heat run testing performed in accordance with ANSI C57.12.90 (1993). The grooved insulating tubes were formed with oil circulation grooves through ribs of inner and outer insulating tubes and on an inner surface of an outer insulating tube. The transformers compared were Catalogue No. EETV111072 10Cl transformers, manufactured by Cooper Industries, Cooper Power Systems Division, Nacogdoches, Tex. Ambient temperatures during the test were 23.6° C. The transformer having a standard core was measured as dissipating 221.8 Watts of power with a top oil temperature rise of 38.6° C. and an average secondary winding rise of 51.7° C. The transformer having the plastic core turn-to-turn grooved insulating tube was measured as dissipating 224.4 Watts of power with a top oil temperature rise of 36.2° C. and an average secondary winding rise of 49.4° C. Accordingly, it is understood that the insulating tube according to the present invention is adapted to provide superior cooling efficiency. The grooves in the plastic core turn-to-turn grooved insulating tube act as ducts to provide a convenient, unobstructed path for oil to pick up the heat from the conductor and deliver to the tank wall. The thermal siphonic flow has less resistance in these "chimneys" and the turn-to-turn grooved insulating tube has more efficient flow than in conventional transformers where paper tends to buckle and crease and hinder the free convection currents through the coils.

The flat member 23 for forming the insulating tube 21 is preferably cut to a desired length from a longer web or extrusion (not shown), to facilitate mass production of insulating tubes. The angles between the ribs 33*a*, 33*b*, . . . , 33(*n*) and the flanges 43 and 45 are slightly larger on the inner insulating tubes 103 than on the outer insulating tubes 105 because of the larger size of the outer insulating tubes. In this manner, appropriate alignment of the first ends 39*a*, 39(*b*), . . . , 39(*n*-1) with corresponding second ends 41(*b*), 41(*c*), . . . , 41(*n*) is achieved upon folding the flat members 23 to form the inner and outer insulating tubes 103 and 105.

While this invention has been illustrated and described in accordance with a preferred embodiment, it is recognized that variations and changes may be made therein without departing from the invention as set forth in the claims.

What is claimed is:

1. A turn-to-turn grooved insulating tube for use in a transformer including a conductor wound through one or more turns, comprising:

a tubular member formed from a flat member, the flat member having first and second longitudinal edges joined together to form the tubular member, the tubular member including a tube wall defining an inner surface and an outer surface;

one or more ribs forming a rib helix on the outer surface, the rib helix defining a substantially continuous helical groove on the outer surface for receiving a conductor wound around the tubular member in one or more winding turns.

2. The turn-to-turn grooved insulating tube as set forth in claim 1, wherein the tubular member is substantially rectangular about a longitudinal axis.

3. The turn-to-turn grooved insulating tube as set forth in claim 1, wherein the groove is formed by forming the ribs on the outer surface of the tubular member.

4. The turn-to-turn grooved insulating tube as set forth in claim 1, further comprising fastening means for fastening together the first and second longitudinal edges.

5. The turn-to-turn grooved insulating tube as set forth in claim 4, wherein the groove is formed by forming the ribs on a surface of the flat member.

6. The turn-to-turn grooved insulating tube as set forth in claim 5, wherein the ribs extend in straight lines between the first and second longitudinal edges of the flat member, the ribs extending at an angle to first and second transverse edges of the flat member such that, when the flat member is bent to form the tubular member, first ends of one or more ribs adjacent the first longitudinal edge align with second ends of corresponding ribs adjacent the second longitudinal edge.

7. The turn-to-turn grooved insulating tube as set forth in claim 1, further comprising one or more grooves formed on the outer surface through the rib helix.

8. The turn-to-turn grooved insulating tube as set forth in claim 7, further comprising one or more grooves formed on the inner surface.

9. The turn-to-turn grooved insulating tube as set forth in claim 1, further comprising one or more grooves formed on the inner surface.

10. A turn-to-turn grooved insulating tube for use in a transformer including a conductor wound through one or more turns, comprising:

a tubular member including a tube wall defining an inner surface and an outer surface; and one or more ribs forming a rib helix on the outer surface, the rib helix defining a substantially continuous helical groove on the outer surface for receiving a conductor wound around the tubular member in one or more winding turns.

11. A transformer winding, comprising:

concentric inner and an outer turn-to-turn grooved insulating tubes, each insulating tube including a tubular member formed from a flat member, the flat member having first and second longitudinal edges joined together to form the tubular member, the tubular member including a tube wall defining an inner surface and an outer surface, and one or more ribs forming a rib helix on the outer surface, the rib helix defining a substantially continuous helical groove on the outer surface for receiving a conductor wound around the tubular member in one or more winding turns;

a first coil formed from a first conductor disposed in the helical groove of the inner insulating tube; and a second coil formed from a second conductor disposed in the helical groove of the outer insulating tube.

12. The transformer winding as set forth in claim 11, wherein one or more oil-circulation grooves are formed on the outer surface of at least one of the inner and the outer insulating tubes through the rib helix.

13. The transformer winding as set forth in claim 11, wherein one or more oil-circulation grooves are formed on the inner surface of at least one of the inner and the outer insulating tubes.

14. The transformer winding as set forth in claim 11, wherein successive turns of the first conductor and the second conductor are insulated from one another by the rib helix of the inner and outer insulating tubes, respectively.

15. The transformer winding as set forth in claim 11, wherein the inner and outer insulating tubes are rectangular.

16. The transformer winding as set forth in claim 11, further comprising a third coil arranged concentrically around the outer insulating tube, the third coil being formed from a third conductor helically wound around the outer insulating tube, and means for insulating the third coil from the second coil.

17. The transformer winding as set forth in claim 16, wherein the third coil is a high voltage coil and the first and second coils are low voltage coils.

18. A method of making a turn-to-turn grooved insulating tube, comprising the steps of:

forming a substantially rectangular flat member having an inner and an outer surface, a first and a second longitudinal edge, and a first and a second transverse edge;

providing a plurality of parallel ribs having first and second ends on the outer surface, the first ends of the ribs extending substantially to the first longitudinal edge and the second ends of the ribs extending substantially to the second longitudinal edge; and joining the first longitudinal edge to the second longitudinal edge, the ribs forming an angle with the first and second transverse edges such that, when the first and second longitudinal edges are joined, the first ends of substantially all of the ribs align with a second end of an adjacent one of substantially all of the ribs, the aligned ribs forming a rib helix.

19. The method as set forth in claim 18, further comprising the steps of forming one or more cuts through the ribs, the cuts being formed substantially parallel to the longitudinal edges, and bending the flat member to position the first and second longitudinal edges adjacent to one another by folding the flat member in the area of the one or more cuts.

20. The method as set forth in claim 18, further comprising the step of removing portions of the ribs to form one or more grooves extending substantially parallel to the longitudinal edges.

21. The method as set forth in claim 18, wherein the flat member and the ribs are formed together.

22. The method as set forth in claim 21, wherein the flat member and the ribs are formed by a molding process.

23. A method of making a transformer, comprising the steps of:

forming a first winding, the first winding being formed by providing an inner turn-to-turn grooved insulating tube, the inner insulating tube including a first tubular member formed from a first flat member, the first flat member having first and second longitudinal edges joined together to form the first tubular member, the first tubular member including a first tube wall defining an inner surface and an outer surface, and one or more ribs forming a first rib helix on the outer surface, the first rib helix defining a substantially continuous first helical groove on the outer surface, winding a first conductor around the inner insulating tube in the first helical groove to form a first coil, providing an outer turn-to-turn grooved insulating tube around the inner insulating tube and the first coil, the outer insulating tube including a second tubular member formed from a second flat member, the second flat member having first and second longitudinal edges joined together to form the second tubular member, the second tubular member including a second tube wall defining an inner surface and an outer surface, and one or more ribs forming a second rib helix on the outer surface, the second rib helix defining a substantially continuous second helical groove on the outer surface, and winding a second conductor around the outer insulating tube in the second helical groove to form a second coil.

24. The method as set forth in claim 23, wherein the first and second conductors are aligned by the first and second helical grooves, respectively, as the first and second conductors are wound around the inner and outer insulating tubes, respectively.

25. The method as set forth in claim 23, comprising the further step of positioning a portion of a magnetic core in an interior opening of the inner insulating tube.

26. The method as set forth in claim 25, comprising the further steps of providing a second winding substantially identical to the first winding, and positioning another portion of the magnetic core in an interior opening of the inner insulating tube of the second winding.

* * * * *